United States Patent [19]

Herbstman et al.

[11] 4,332,595

[45] Jun. 1, 1982

[54] ETHER AMINE DETERGENT AND MOTOR FUEL COMPOSITION CONTAINING SAME

[75] Inventors: Sheldon Herbstman, Spring Valley; Joseph B. Biasotti, Lagrangeville, both of N.Y.; Michael E. Brennan, Austin, Tex.

[73] Assignee: Texaco Inc., White Plains, N.Y.

[21] Appl. No.: 213,428

[22] Filed: Dec. 5, 1980

[51] Int. Cl.[3] ..... C10L 1/22

[52] U.S. Cl. ..... 44/72; 44/77; 564/505

[58] Field of Search ..... 564/505; 44/72, 77

[56] References Cited

U.S. PATENT DOCUMENTS

| | | | |
|---|---|---|---|
| 4,234,321 | 11/1980 | Lilburn | 44/72 |
| 4,247,301 | 1/1981 | Honnen | 564/505 |
| 4,252,745 | 2/1981 | Kwong et al. | 44/72 |

*Primary Examiner*—Winston A. Douglas
*Assistant Examiner*—J. V. Howard
*Attorney, Agent, or Firm*—Carl G. Ries; Robert A. Kulason; James J. O'Loughlin

[57] ABSTRACT

A detergent additive represented by the formula:

$$R—[O—CH_2—CH(CH_3)]_y—NH—(CH_2)_3—NH_2$$

in which R is a hydrocarbyl radical having from 8 to 18 carbon atoms and y is about 2 to 6, and a gasoline motor fuel composition containing same.

16 Claims, No Drawings

ETHER AMINE DETERGENT AND MOTOR FUEL COMPOSITION CONTAINING SAME

BACKGROUND OF THE INVENTION

1. Field of the Invention

Modern internal combustion engine design is undergoing important changes to meet stricter standards concerning engine and exhaust gas emissions. One major change in engine design is the feeding of blow-by gases from the crankcase zone of the engine into the intake air-fuel mixture at the carburetor just below the throttle plate, rather than venting these gases to the atmosphere as in the past. The blow-by gases contain substantial amounts of deposit forming substances and are known to form deposits in and around the throttle plate area of the carburetor. Another significant change is the recirculation of a part of the exhaust gases to the fuel air intake of the engine. These exhaust gases also have deposit forming tendencies. The deposits caused by the recirculated gases, both blow-by and exhaust gases, restrict the flow of air through the carburetor at idle and at low speeds so that an over-rich fuel mixture results. This condition produces rough engine idling and stalling and leads to the release of excessive hydrocarbon exhaust emissions to the atmosphere.

The noted design changes while effective for prompting a cleaner exhaust from the engine also leads to a fouling of the carburetor and therefore dictates the need for an effective detergent fuel composition in order to maintain the cleanliness and efficiency of the carburetor.

2. Description of the Prior Art

U.S. Pat. No. 3,980,450 discloses a carburetor detergent compound of the formula:

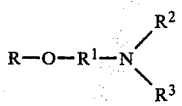

where R is a hydrocarbyl group containing at least 20 carbon atoms, $R^1$ is a hydrocarbyl or amino substituted hydrocarbyl group and $R^2$ and $R^3$, which may be the same or different, are hydrogen atoms or alkyl groups and a gasoline composition containing same.

U.S. Pat. No. 3,849,083 discloses a gasoline containing a carburetor detergent amount of ether amine selected from:

I. $R—O—L—NH_2$

II. $(R—O—L—)_2NH$ and

III. mixture containing (I) and (II)

wherein R is selected from $C_1$–$C_{40}$ alkyl groups, $C_6$–$C_{40}$ aryl groups and $C_3$–$C_{40}$ alkenyl groups, and L is $C_2$–$C_8$ alkylene, and additive concentrates suitable for blending into gasoline containing said ether amine detergent.

U.S. Pat. No. 3,309,182 discloses polyether diamines as inhibitors of sludge sediment formation in petroleum distillate fuels.

SUMMARY OF THE INVENTION

This invention pertains to a carburetor detergent additive represented by the formula:

$$R—[O—CH_2—CH(CH_3)]_y—NH—(CH_2)_3—NH_2$$

in which R is a hydrocarbyl radical having from 8 to 18 carbon atoms and y is about 2 to 6 and a motor fuel composition comprising a major portion of a mixture of hydrocarbons boiling in the gasoline boiling range containing same.

The group R preferably contains 10 to 18 carbon atoms, most preferably from 16 to 18.

Also, y is preferably 2 to 5, most preferably about 2 to 4.

DESCRIPTION OF THE PREFERRED EMBODIMENTS

The aminopropylated ether amines of this invention are represented by the following formula:

$$R—[OCH_2CH(CH_3)]_y—NH—(CH_2)_3—NH_2$$

where R is a hydrocarbyl radical having 8 to 18 carbon atoms and y is about 2 to 6 inclusive.

These compounds are prepared using linear primary alcohols, having from about 8 to 18 carbon atoms as starting materials. These starting materials must first be propoxylated to add the desired number of propoxy groups to the alkyl moiety. The propoxylation reaction, which is essential for the aminopropylated ether-amines of this invention, is conducted by methods well known to those skilled in the art by reacting the linear primary alcohol with the propylene oxide in the presence of a catalyst, usually a basic material such as potassium hydroxide.

The propoxylated alcohols are reacted with ammonia using a known method of catalytic liquid phase reductive amination. This step is accomplished via the procedures of U.S. Pat. No. 3,390,184 which is concerned with converting long chain secondary alcohols to the corresponding primary amines by reaction with ammonia in the liquid phase in the presence of a hydrogenation-dehydrogenation catalyst.

The preferable catalyst of the ammonolysis would be one containing nickel, copper and chromium as described, for example, in U.S. Pat. No. 3,152,998. This catalyst is generally prepared by the reduction of a mixture of the oxides of nickel, copper and chromium in the presence of hydrogen at a temperature within the range of about 250° to 400° C. Calculated on an oxide-free basis, the catalyst contains 60 to 85 mole percent nickel. A particularly preferred catalyst composition is one containing 70 to 80 mole percent nickel, 20 to 25 mole percent copper and 1 to 5 mole percent chromium.

The ammonolysis reaction is generally conducted at a temperature of from about 190° to about 250° C. with the preferable range being about 200° to about 240° C. The pressure conditions for this reaction are from about 1000 to 5000 psig with the preferable range being from 1500 to 3000 psig, this pressure being partly due to the presence of excess hydrogen. Ammonia is introduced into the reaction such that the ammonia to alcohol mole ratio is from 5 to 40 moles of ammonia per hydroxyl group to be aminated. It is preferable that from about 10 to 30 moles of ammonia per mole of alcohol be present. The reaction can be conducted either as a batch or a continuous reaction.

The aminated material, now containing internal ether groups from the reaction with the propylene oxide and a primary amine group on one end of the molecule is reacted with one equivalent of acrylonitrile at 35° C. in a methanolic solution to give the corresponding N-2-cyanoethyl derivative. This reaction solution was then hydrogenated at 120° C. in the presence of six moles of ammonia per mole of nitrile, hydrogen and a cobalt-copper-chromium catalyst. The product is filtered and the ammonia and methanol is removed to yield the desired N-3-aminopropyl ether-amine:

$$CH_3(CH_2)_{8-18}CH_2[OCH_2CH(CH_3)]_2\cdot 6NH(CH_2)_3NH_2$$

Specific examples of the aminopropylated ether amines of this invention include: N-1-(oleyl isopropoxyl)-1,3-propane diamine; N-1-[stearyl (polyisopropoxyl)3]-1,3-propane diamine; N-1-[octyl (polyisopropoxyl)1.75]-1,3-propane diamine; N-1-[eicosane (polyisopropoxyl)3.4]-1,3-propane diamine; N-1-[pentadecyl (polyisopropoxyl)4.1]-1,3-propane diamine; N-1-[isodecyl isopropoxyl]-1,3-propane diamine; N-1-[3-phenylisodecyl isopropoxyl]-1,3-propane diamine.

The N-3-aminopropylated ether amines of the invention are employed in a gasoline motor fuel composition at a concentration effective to provide or to enhance the carburetor detergency properties of the fuel composition. In general, an effective concentration of the additive ranges from about 0.00032 to 0.0192 volume percent based on the volume of the fuel composition with a preferred concentration ranging from about 0.00092 to 0.0016 volume percent. The former limits correspond to from 1 to 60 PTB and the latter limits correspond to the preferred range of about 3 and 5 PTB (pounds of additive per 1000 barrels of fuel).

Methods for preparing the aminopropylated ether-amines useful in the present invention are as follows:

EXAMPLE I

Propoxylation of a C16, C18 Linear Primary Alcohol:

A clean and dry nitrogen purged 7-gallon kettle, equipped with stirring and heating means, was charged with 21.0 lbs (35.4 moles) of melted C16, C18 linear primary alcohols (206-211 hydroxyl no.) and 30.0 grams of flaked potassium hydroxide. The mixture was heated to 120° C. and then 19.8 lbs (154.6 moles of propylene oxide were added over a period of 7.0 hours. After allowing this reaction mixture to further digest for 2.0 hours at 110°-120° C., 36 grams of oxalic acid were added at 110° C. to neutralize the basic catalyst. Then the whole mixture was filtered at 110° C. to remove the formed salts. The product, a propoxylate alcohol of the formula: CH3(CH2)14,16CH2[OCH2CH(CH3)]4OH, was clear and colorless liquid (113.8 hydroxyl no.) with a molecular weight of 493.1 (calculated).

Reductive Amination of the Propoxylate Alcohol:

This propoxylate alcohol was then reductively aminated in a 500 ml stainless steel continuous tubular reactor containing 475 ml of a proprietary nickel-copper-chromium catalyst (U.S. Pat. No. 3,152,998). The reaction conditions were as follows:

| | |
|---|---|
| Propoxylated alcohol, lbs/hr | 0.61 |
| Anhydrous ammonia, lbs/hr | 0.42 |
| Space velocity, g/ml cat/hr | 0.98 |
| 75% H2:25% N2, 1/hr (STP) | 50 |
| Temperature, °C. | 215.2 |
| Pressure, psig | 2500 |
| Ammonia/organic (moles) | 20.1 |

Prerun was 2.0 hrs and on-stream was 4.0 hrs. The effluent was stripped of ammonia and water to give a clear and colorless liquid ether amine product, CH3(CH2)14,16CH2 [OCH2CH(CH3)]4NH2, which analyzed as follows:

| | |
|---|---|
| Total titratable amine, meg/g | 1.82 |
| Primary amine, meg/g | 1.74 |
| Hydroxyl no. | 114.5 |
| % Nitrogen | 2.73 |
| % Water | 0.05 |

The above titration techniques indicated that 89.2% conversion had been achieved and that the amine present contained 95.6% primary amine.

Aminopropylation of the Ether-Amine

A methanolic solution of the above-synthesized ether amine was reacted with one equivalent of acrylonitrile at 35° C. to give the corresponding N-2-cyanoethyl derivative. This reaction solution was then transferred to a 1-gallon stirred autoclave and hydrogenated at 120° C. in the presence of hydrogen, six moles of ammonia per mole of nitrile and 25 grams of proprietary cobalt-copper-chromium catalyst per mole of nitrile. The maximum pressure in the autoclave was 1420 psig and the total reaction time was 1⅔ hours. After filtration and ammonia and methanol removal, the desired N-3-aminopropyl ether-amine, CH3(CH2)14,16CH2[OCH2CH(CH3)]4 NH(CH2)3NH2, a yellow to brown mobile liquid bottoms product, was obtained in excellent yield. Product structure was confirmed by nuclear magnetic resonance (NMR) and infrared (IR) spectra. The material analyzed as follows:

| | |
|---|---|
| Total titratable amine meg/g | 3.21 |
| Primary amine, meg/g | 1.64 |
| Secondary + tertiary amine, meg/g | 1.52 |
| Total acetylatables, meg/g | 3.85 |
| % Nitrogen | 4.49 |
| % Water | 0.11 |

EXAMPLE 2

Propoxylation of a C10,12 Linear Primary Alcohol

The mixture of decyl, dodecyl alcohol propoxylated was EPAL(R) 1012 which is manufactured by the Ethyl Corporation. More specifically, EPAL(R) contains 0.2 C6, 204 C8, 75.1 C10, 6.2 n-C12 and 16.1% iso-C12 alcohols (m.w. 162; 347 hydroxyl no.). The 1.75 mole propoxylate, CH3(CH2)8,10CH2[OCH2CH(CH3)]1.75OH (213.1 hydroxyl no.), was prepared according to the method of propoxylation described in Example I.

Reductive Amination of the Propoxylated Alcohol

This propoxylated alcohol was then reductively aminated in a continuous reactor by the reductive amination procedure described in Example I. A clear and colorless liquid ether amine product, CH3(CH2)8,10CH2[OCH2CH(CH3)]1.75 NH2, was obtained which analyzed as follows:

| | |
|---|---|
| Total titratable amine, meq/g | 3.59 |
| Primary amine, meq/g | 3.49 |
| Hydroxyl no. | 207.6 |

The above titration techniques indicated that 97.0% conversion had been obtained and that the amine present contained 97.2% primary amine.

Aminopropylation of the Ether-Amine

The compound, CH3(CH2)8,10CH2[OCH2CH(CH3)]1.75NH(CH2)3NH2, was prepared from CH3(CH2)8,10CH2[OCH2CH(CH3)] 1.75NH2, by the same procedure for aminopropylation described in Example I. Product structure was confirmed by Nuclear Magnetic Resonance (NMR) and Infrared (IR) spectra. The material analyzed as follows:

| | |
|---|---|
| Total titratable amine, meq/g | 5.64 |
| Primary amine, meq/h | 2.93 |
| Secondary + tertiary amine, meq/g | 2.60 |
| Total acetylatables, meq/g | 5.84 |
| % Nitrogen | 7.84 |

The base fuel employed for preparing the motor fuel composition of the invention comprises a mixture of hydrocarbons boiling in the gasoline boiling range. This base fuel may consist of straight chain or branched chain paraffins, cycloparaffins, olefins, aromatic hydrocarbons or any mixture of these. The base fuel can be derived from straight run naphtha, polymer gasoline, natural gasoline or from catalytically cracked or thermally cracked hydrocarbons and catalytically reformed stocks.

The composition of hydrocarbon components of the base fuel is not critical nor does the octane level of the base fuel have any material effect on the motor fuel composition of the invention.

The fuel composition may contain any of the additives normally employed in gasoline. Thus, the fuel composition can contain an anti-knock compound such as tetraalkyl lead compound, including tetraethylead, tetramethyllead, tetrabutyllead and mixtures thereof. The fuel composition can also contain anti-icing additives, dyes, upper cylinder lubricating oils and the like.

The N-3-aminopropylated ether amine additive of the invention was tested for its effectiveness as a detergent in gasoline in the Chevrolet Carburetor Detergency Test. In this test, a gasoline fuel composition containing the additive is tested for its ability to remove preformed deposits from the throttle plate area in a carburetor. This test is run on a Chevrolet V-8 engine mounted on a test stand using a modified four-barrel carburetor. The two secondary barrels on the carburetor are sealed. The feed to each of the primary barrels is arranged so that the detergent additive fuel can run in one barrel and a reference fuel or a base fuel run in the other. The primary carburetor barrel was also modified to contain removable aluminum inserts in the throttle plate area so that the deposits formed on the insert could be conveniently weighed.

The engine is run for a period of time usually 24 or 48 hours using the base fuel as the feed to both barrels with the engine blow-by circulated to the air inlet of the carburetor to cause a deposits build-up. The weight of the deposits on both sleeves is determined and recorded. The engine is then cycled for 24 additional hours with the reference fuel or base fuel being fed to one barrel and the additive fuel to the other. During this cycle, engine blow-by is circulated to the air inlet of the carburetor. The inserts are then removed from the carburetor and weighed to determine the difference between the performances of the additive-containing fuel of the invention and the reference fuel or base fuel for removing preformed deposits. After the aluminum inserts have been cleaned, they are replaced in the carburetor and the process repeated with the fuel feed inlet to the carburetor reversed in order to minimize differences in fuel distribution and carburetor construction. The results obtained in the fuel runs are averaged and the effectiveness of the reference fuel and of the additive fuel for removing deposits expressed in percent.

The Base Fuel employed for testing the detergent additive of the invention is a premium grade gasoline having a Research Octane Number of about 92. This gasoline consists of about 30 volume % aromatic hydrocarbons, 17 volume % olefinic hydrocarbons and 53 volume % paraffinic hydrocarbons and boils in the range from 90° to 410° F. This base fuel gives a Throttle Plate Merit Rating of about 3.6 in the Buick Carburetor Detergency Test.

The carburetor detergency test results obtained from the base fuel, comparison fuels and the fuel compositions containing the N-3-aminopropylated ether amine prepared are set forth in Table I below:

TABLE I

CHEVROLET CARBURETOR DETERGENCY TEST[a]

| Run No. | Fuel Composition | Deposit Build-up,mg.* | Deposit Removed,mg. | wt. % Percent Effective |
|---|---|---|---|---|
| 1. | Base Fuel | 16.8 | (+1.7)** | +10** |
| 2. | Commercial Detergent Fuel | 20.2 | 16.0 | −79 |
| 3. | Base Fuel + 50 PTB of Example II, $CH_3(CH_2)_{8,\ 10}CH_2[OCH_2CH(CH_3)]_{1.75}NH(CH_2)_3NH_2$ | 22.4 | 19.2 | −86 |
| 4. | Base Fuel + 50 PTB $CH_3(CH_2)_{19}\ [OCH_2CH(CH_3)]_{3.4}NH(CH_2)_3NH_2$ | 23.7 | 17.2 | −73 |
| 5. | Base Fuel + 50 PTB of Example I, $CH_3(CH_2)_{14,\ 16}CH_2[OCH_2CH(CH_3)]_4NH(CH_2)_3NH_2$ | 22.4 | 19.6 | −88 |

*Built up with base fuel.
[a]Clean-up type test.
**Deposit build-up.
PTB-pounds of additive per 1000 barrels of fuel.

The fuel composition containing the aminopropylated ether-amine additive of the invention was outstanding as a carburetor detergent for removing preformed deposits from the throttle plate area of the carburetor.

The additive of the invention was also tested for its effectiveness as a carburetor detergent in the Buick Carburetor Detergency Test. This test is run on a Buick 350 Cubic Inch Displacement V-8 engine equipped with a two barrel carburetor. The engine is mounted on a test stand and has operating Exhaust Gas Recirculation and Positive Crankcase Ventilation systems. The test cycle, shown in Table II, is representative of normal road operation. Approximately 300 gallons of fuel and three quarts of oil are required for each run.

Prior to each run the carburetor is completely reconditioned. Upon completion of the run the throttle plate deposits are visually rated according to a Coordinating Research Council Varnish rating scale (Throttle Plate Merit Rating) where 1 describes heavy deposits on the throttle plate and 10 a completely clean plate.

TABLE II

BUICK CARBURETOR DETERGENCY TEST[a]

| Run No. | Fuel Composition | Carburetor Rating |
|---|---|---|
| 1. | Base Fuel | 3.6 |
| 2. | 5PTB of Example I, $CH_3(CH_2)_{14,16}CH_2[OCH_2CH(CH_3)]_4NH(CH_2)_3NH_2$ | 7.9 |
| 3. | 3PTB of Example I, $CH_3(CH_2)_{14,16}CH_2[OCH_2CH(CH_3)]_4NH(CH_2)_3NH_2$ | 7.2 |

[a]Keep clean type test.

The additive fuel composition consisting of the Base Fuel described above containing 3 PTB (pounds of additive per thousand barrels of fuel) of the aminopropylated ether amine substantially improves the Throttle Plate Merit Rating over that of the Base Fuel.

The additive fuel composition consisting of the Base Fuel containing 5 PTB of the compound aminopropylated ether amine provides a surprising improvement in the Throttle Plate Merit Rating over that of both the Base Fuel and the additive fuel containing 3 PTB of aminopropylated ether amine.

The improvement in the detergency property of the novel fuel compositions of the invention from the use of the novel detergent additives is a noteworthy advance in the provision of a modern detergent fuel composition.

We claim:

1. A compound having the following formula:

$$R—[O—CH_2—CH(CH_3)]_y—NH—(CH_2)_3—NH_2$$

where R is a hydrocarbyl radical having from 8 to 18 carbon atoms and y is about 2 to 6.

2. A compound according to claim 1 where R is a hydrocarbyl radical having from 10 to 18 carbon atoms.

3. A compound according to claim 1 where R is a hydrocarbyl radical having 16 to 18 carbon atoms.

4. A compound according to claim 1 where y is about 2 to 5.

5. A compound according to claim 3 where y is about 2 to 5.

6. A motor fuel composition comprising a mixture of hydrocarbons in the gasoline boiling range and containing an additional compound having the formula:

$$R—[O—CH_2—CH(CH_3)]_y—NH—(CH_2)_3—NH_2$$

where R is a hydrocarbyl radical having from 8 to 18 carbon atoms and y is about 2 to 6.

7. A motor fuel composition comprising a mixture of hydrocarbons in the gasoline boiling range and containing a compound with the formula in claim 6, but where R is a hydrocarbyl radical having from 10 to 18 carbon atoms.

8. A motor fuel composition comprising a mixture of hydrocarbons in the gasoline boiling range and containing a compound with the formula in claim 6, but where R is a hydrocarbyl radical having from 16 to 18 carbon atoms.

9. A motor fuel composition comprising a mixture of hydrocarbons in the gasoline boiling range and containing a compound with the formula in claim 6, but where R is a hydrocarbyl radical having from 10 to 18 carbon atoms and y is 2 to 5.

10. A motor fuel composition comprising a mixture of hydrocarbons in the gasoline boiling range and containing a compound with the formula in claim 6, but where R is a hydrocarbyl radical having 16 to 18 carbon atoms and y is 2 to 5.

11. A motor fuel composition according to claim 6, wherein the additive compound is from about 0.00032 to 0.0192 volume % of the fuel composition.

12. A motor fuel composition according to claim 6 wherein the concentration of the additive compound ranges from about 0.00092 to 0.0016 volume % of the motor fuel composition.

13. A motor fuel composition comprising a mixture of hydrocarbons in the gasoline boiling range and containing N-1-(oleyl isopropoxyl)-1,3-propane diamine.

14. A motor fuel composition comprising a mixture of hydrocarbons in the gasoline boiling range and containing N-1-[pentadecyl(polyisopropoxyl)$_{4.1}$]-1,3, propane diamine.

15. A motor fuel composition comprising a mixture of hydrocarbons in the gasoline boiling range and containing N-1-[stearyl(polyisopropoxy)$_3$]-1,3-propane diamine.

16. A motor fuel composition according to claim 6, containing the additive compound in an amount effective for imparting carburetor detergency properties to the fuel composition.

* * * * *